US011161662B2

(12) United States Patent
Griffin

(10) Patent No.: US 11,161,662 B2
(45) Date of Patent: Nov. 2, 2021

(54) RETRACTABLE CAP FOR A NOZZLE OF A CAULKING TUBE RETAINED IN A CAULKING GUN

(71) Applicant: Diarmuid Griffin, Woodland Hills, CA (US)

(72) Inventor: Diarmuid Griffin, Woodland Hills, CA (US)

(73) Assignee: Diarmuid Griffin, Woodland Hills, CA (US)

( * ) Notice: Subject to any disclaimer, the term of this patent is extended or adjusted under 35 U.S.C. 154(b) by 137 days.

(21) Appl. No.: 16/525,405

(22) Filed: Jul. 29, 2019

(65) Prior Publication Data

US 2020/0031546 A1 Jan. 30, 2020

Related U.S. Application Data

(60) Provisional application No. 62/711,583, filed on Jul. 29, 2018.

(51) Int. Cl.

| | |
|---|---|
| ***B65D 55/16*** | (2006.01) |
| ***B65D 41/02*** | (2006.01) |
| ***B65D 47/12*** | (2006.01) |
| ***B65D 47/06*** | (2006.01) |
| ***A45F 5/00*** | (2006.01) |
| ***B05C 17/01*** | (2006.01) |
| ***B05C 17/005*** | (2006.01) |

(Continued)

(52) U.S. Cl.

CPC ..... *B65D 55/16* (2013.01); *A45F 5/004* (2013.01); *B05C 17/00596* (2013.01); *B05C 17/0123* (2013.01); *B65D 41/02* (2013.01); *B65D 47/06* (2013.01); *B65D 47/12* (2013.01); *B05C 17/0052* (2013.01); *B05C 17/00586* (2013.01); *B65D 11/08* (2013.01); *B65D 47/148* (2013.01)

(58) Field of Classification Search

CPC ..... B65D 55/16; B65D 47/148; B65D 47/12; B65D 47/06; B65D 41/02; B65D 11/08; B05C 17/00596; B05C 17/0123; B05C 17/0052; B05C 17/00586; A45F 5/004

See application file for complete search history.

(56) References Cited

U.S. PATENT DOCUMENTS 728,433 A * 5/1903 Baeuerle ..... B65D 47/061 222/482

2,757,824 A * 8/1956 Savary ..... B65D 47/18 222/209

(Continued)

*Primary Examiner* — Vishal Pancholi
*Assistant Examiner* — Bob Zadeh
(74) *Attorney, Agent, or Firm* — David IP Law

(57) ABSTRACT

An apparatus for capping the tip of the nozzle of a caulking tube retained in a caulking gun to prevent the caulking tube from leaking caulking material such as latex or silicone during non-use. The apparatus has a cap portion, a housing portion, and a retractable flexible cord to provide a retractable cap to be used with the caulking tube placed in a caulking gun to prevent leakage when the caulking gun and caulking tube are not in use. The housing contains a retraction member which is placed under force when the cap is pulled away from the retraction member and placed over the tip of the caulking tube nozzle. When the cap is removed from the caulking tube nozzle, the tension from the retraction member causes the flexible cord to pull the cap to a location adjacent the housing so that the cap can be easily retrieved and not lost.

20 Claims, 7 Drawing Sheets

(51) Int. Cl.
*B65D 47/14* (2006.01)
*B65D 8/02* (2006.01)

(56) References Cited

U.S. PATENT DOCUMENTS 2,826,455 A * 3/1958 Furton ..... B64D 37/005
222/505
2,887,240 A * 5/1959 Deussen ..... B65D 47/147
215/250
3,193,146 A * 7/1965 Isgriggs ..... B05C 17/0123
222/82
5,154,327 A * 10/1992 Long ..... B05C 17/00596
222/326

* cited by examiner

RETRACTABLE CAP FOR A NOZZLE OF A CAULKING TUBE RETAINED IN A CAULKING GUN

CROSS REFERENCE TO RELATED APPLICATIONS

This application claims priority from provisional patent application 62/711,583, filed on Jul. 29, 201, which is incorporated by reference herein.

BACKGROUND

The present invention relates generally to the field of construction tool accessories, and more particularly to a retractable cap for a nozzle of a caulking tube retained in a caulking gun.

The present invention is an apparatus for capping the end of a nozzle of a caulking tube retained in a caulking gun. The caulking tube has a cylindrical sidewall terminating at a front end in a nozzle and terminating at the rear end in a generally flat rear wall. The caulking tube is placed in a caulking gun. The nozzle is inserted through a front opening in the caulking gun, and the rear end wall of the caulking tube is adjacent a ratchet assembly in the caulking gun. The caulking tube contains caulking material. The front end of the nozzle is opened so that the caulking material is dispensed though the front opening in the nozzle. A cap is placed over the front of the nozzle to prevent the contents from leaking out of the caulking tube.

In operation, the cap is removed and the ratchet assembly is operated by squeezing a trigger portion which pushes the back wall into the caulking tube to squeeze the contents out of the front opening in the nozzle. As the trigger is activated, the ratchet mechanism advances the back wall into the caulking tube interior to compress and force the caulking material from the interior.

The problem addressed by the present invention is retaining the cap after it is removed from the nozzle. A user may place the cap on a surface and forget where the cap was placed, or the cap may roll away and be lost.

The present invention provides an apparatus for retaining the cap on the distal end of a flexible cord where the proximal end of the flexible cord is affixed to a retention mechanism in a housing. The housing uses an affixing member to affix the housing member to the caulking gun, usually on a sidewall adjacent to the ratchet assembly. The cap can be pulled away from the retraction member and placed on the nozzle to seal the nozzle and stop any caulking material from leaking.

The retraction member exerts the pulling or retraction effect on the cap to retract the cap into a stowed position. The pulling effect on the cap is transmitted by the flexible cord, which transmits the force from the retraction member by tightening the retraction member and causing the retraction member to compress and creates a tension force. When the cap is removed from the nozzle, the retraction member, which is under compressed tension, causes the flexible cord to be pulled back into the housing so that the cap lies adjacent to the exterior of the housing. In this stowed position, the cap will not be misplaced or lost.

When the caulking process is complete, the cap is grasped and a pulling force causes the flexible cord to be once again pulled out of the housing, so the cap is placed on the opening to prevent the caulking tube from leaking latex, silicone, or other caulking material during non-use.

There is a need for a retention for the cap that includes a retractable mechanism that retracts a nozzle cap out of the way while using the caulking gun.

SUMMARY

The present application discloses a retracting caulking tube nozzle cap that secures a nozzle cap to a caulking gun.

In some embodiments, the inventions include a cap portion, a housing portion, and a retractable flexible cord. During the construction of projects, contractors and users of a caulking gun consistently have the need to use the caulking gun for a period of time to create a water tight seal or to fill a gap. Often, immediately after use of a caulking gun, there is a need to perform a second task and the caulking gun needs to be temporarily stored until the caulking gun is needed again. It is common for the caulking tube in the caulking gun to leak latex or silicone if the caulking gun is laid down or inverted.

In some embodiments, the inventions provide a cap affixed to the nozzle of a caulking tube so that once the caulking tube is open, caulking material will not flow out of the caulking tube unless intentionally flows via the ratchet mechanism. The caulking tube is placed in a caulking gun. The innovation is to have a cap attached to a flexible cord and the opposite end of the flexible cord affixed to a retractable mechanism. If the cap is removed, tension from the retraction mechanism on the flexible cord causes the cap to be pulled backward to be adjacent the housing where the retraction mechanism is located. Therefore, this provides a mechanism by which the cap is not lost if it is set down in a separate place where it could easily be mislaid. Therefore, this innovation assures that the cap can be located when it is necessary to replace the cap onto the caulking nozzle after the caulking gun has been used, and it enables capping the nozzle so that no caulking material will flow out.

In some embodiments, the inventions provide a housing retaining a retraction mechanism affixed to a clip, which is affixed to a location near the ratchet mechanism remote from where the cap is affixed to the front of the discharge nozzle of the caulking tube. The cap is affixed to a flexible cord. The flexible cord at its proximal end is affixed to the retraction mechanism, and the flexible cord at its distal end is affixed to the cap. Therefore, when the cap is pulled away from the housing, the retraction mechanism is placed under tension and then the cap is placed onto the front of the nozzle. When it is necessary to remove the cap, after the cap is removed the tension from the source of retraction causes the flexible cord to pull the cap to a location adjacent the housing where it is clipped to the caulking gun so that the cap can be located when it is desired to reaffix it to the front of the nozzle.

In some embodiments, the present inventions provide a cap that is sized to receive the end of the nozzle of a caulking tube.

In some embodiments, the present inventions provide a flexible cord that connects the cap to the housing with the flexible cord being retractable. The flexible cord is connected to a recoil spring that becomes biased or loaded when the cap is pulled or extended away from the housing.

Said invention is an apparatus for capping the tip of a nozzle of a caulking tube retained in a caulking gun, the apparatus comprising:

a. a housing portion, a cap portion, and a flexible cord with said housing portion having a housing front vertical wall and a housing rear vertical wall;

b. said housing front vertical wall having a front vertical wall opening that leads to a housing interior chamber which contains a retraction member that is affixed to a proximal end of said flexible cord;

c. a distal end of said flexible cord affixed to a closed end of said cap portion, said cap portion having an opening leading to an interior chamber that is surrounded by a circumferential vertical wall with said closed end opposite to the opening;

d. said interior chamber of said cap is sized to receive said tip of said nozzle;

e. said housing portion having a spring clip affixed to at least one of the housing exterior sidewalls with said spring clip having a first clip vertical wall that is flush and parallel with at least one of the housing exterior sidewalls;

f. said first clip vertical wall is retained within at least one housing exterior sidewall opening and said first clip vertical wall extends towards said housing rear vertical wall and contains an approximate 180 degree curve to form a second clip vertical wall that extends at a downward angle towards at least one of the housing exterior sidewalls until reaching a connection point and then extending upward for a distance;

g. whereby, in operation, the cap is pulled away from the retraction member and placed over the tip of the nozzle, the pulling effect causes the retraction member to be forced into tension, and when the cap is removed from the tip of the nozzle, the retraction member causes the flexible cord to be pulled back into the housing so that the cap is adjacent to the exterior of the housing.

Further novel features and other objects of the present invention will become apparent from the following detailed description and discussion.

The disclosed innovations, in various embodiments, provide one or more of at least the following advantages. However, not all of these advantages result from every one of the innovations disclosed, and this list of advantages does not limit the various claimed inventions.

Increased productivity.

Ease of keeping track of a caulking nozzle cap.

Improved cleanliness.

Decreased incidents of waste from leaking caulk.

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF SAMPLE EMBODIMENTS

Figure 1A:
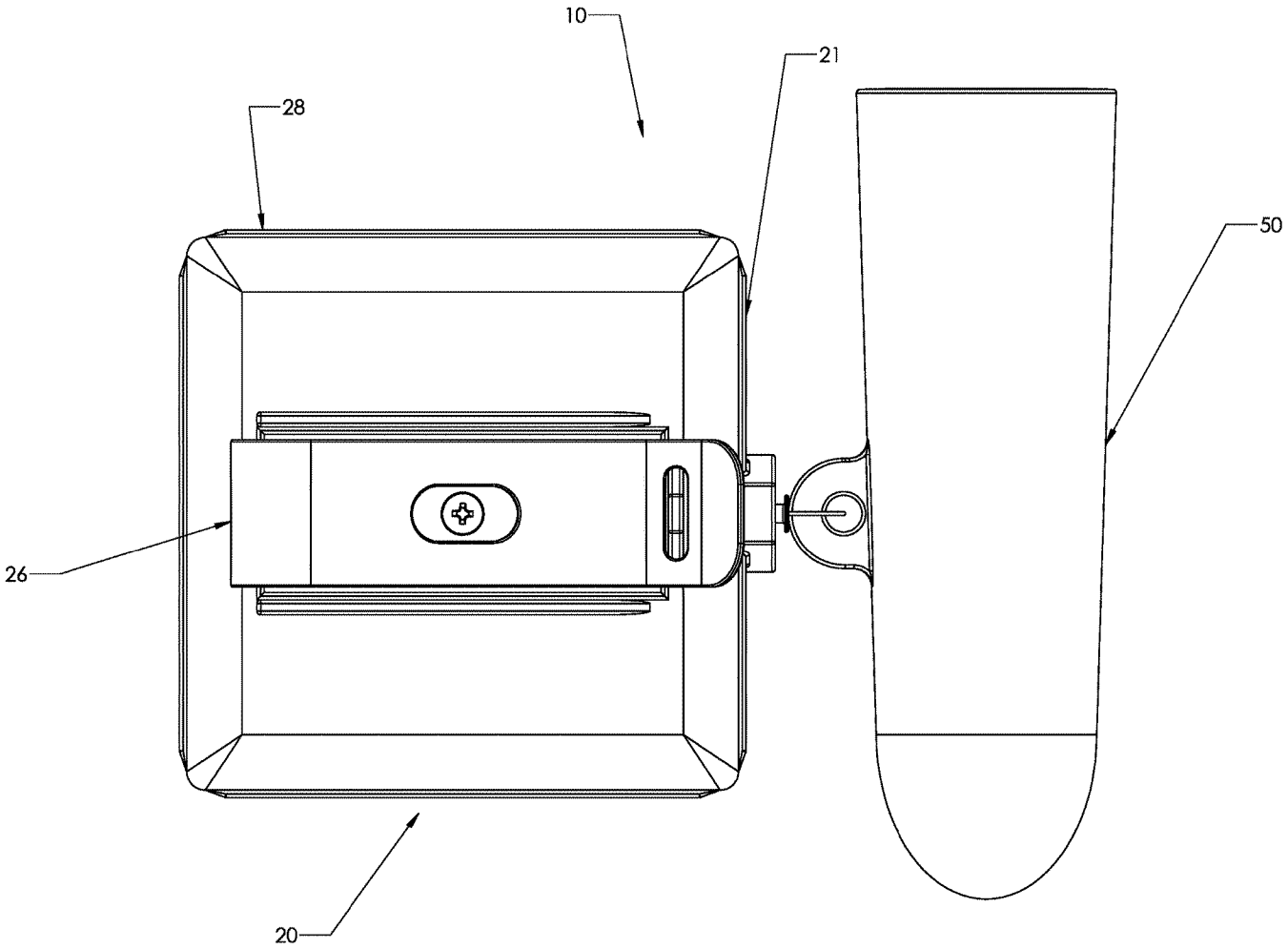
FIG. 1A is a top perspective view of the present invention caulking gun retractable member with the nozzle cap in the retracted condition.

The numerous innovative teachings of the present application will be described with particular reference to presently preferred embodiments (by way of example, and not of limitation). The present application describes several inventions, and none of the statements below should be taken as limiting the claims generally.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples.

Exemplary embodiments are described below in the accompanying Figures. The following detailed description provides a comprehensive review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

Figure 1B:
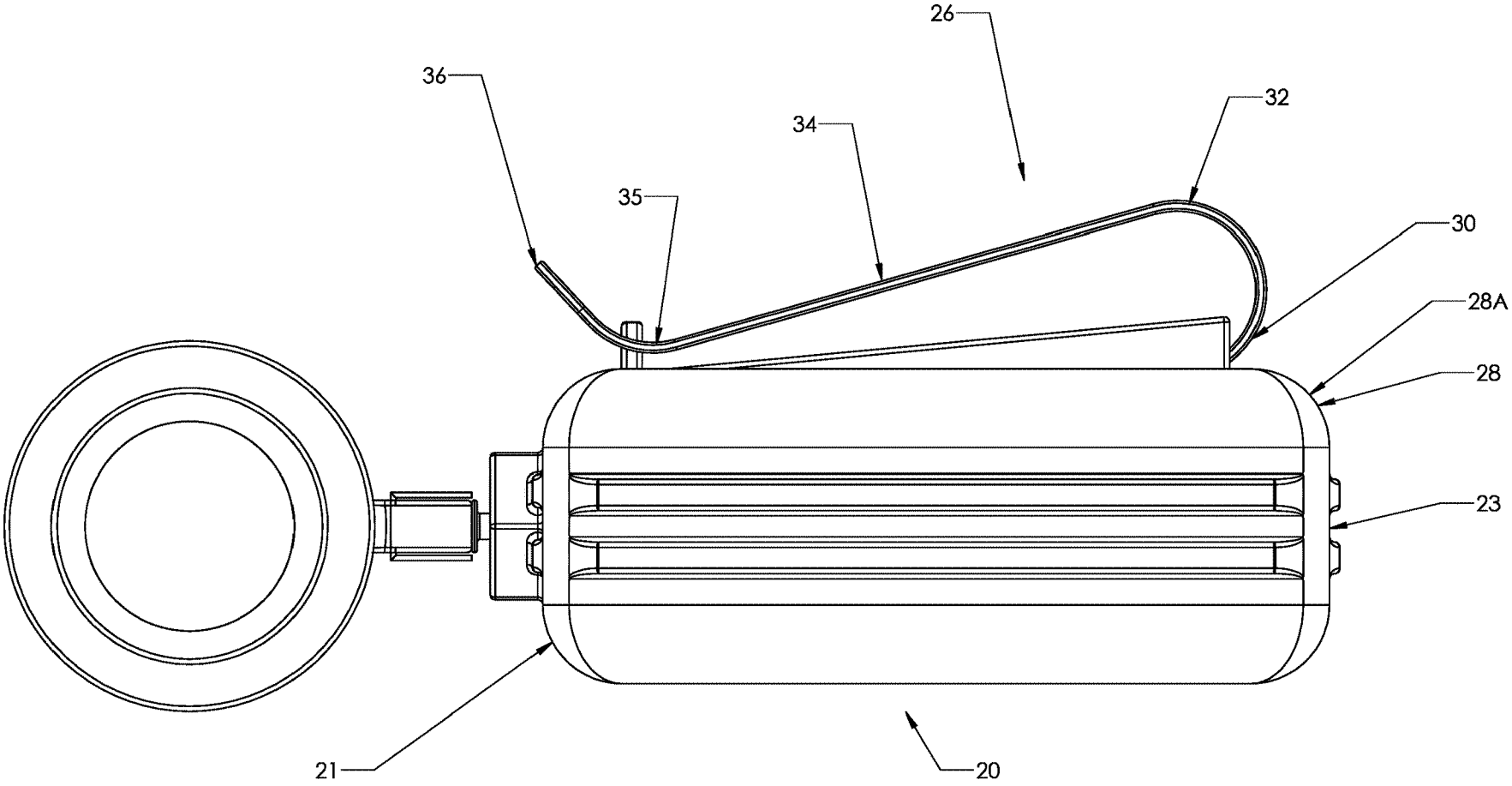
FIG. 1B is a side perspective view of the present invention caulking gun retractable cap in the retracted condition.
Figure 1C:
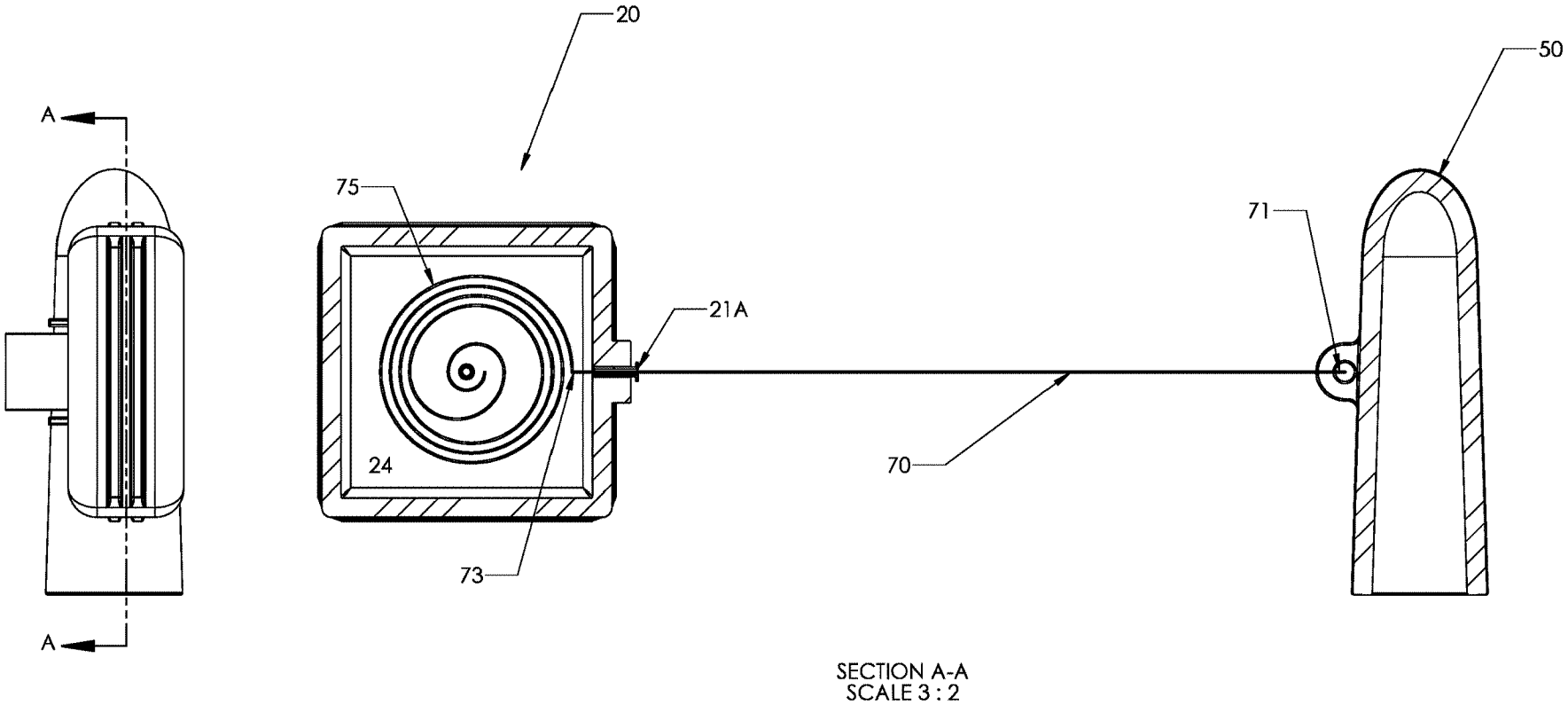
FIG. 1C is a cross-sectional view of the housing member including the interior of the housing member, the coil spring retraction member and the flexible cord affixed to the retraction member at a proximal end and affixed to a cap (illustrated in a side-perspective view) at the distal end at the flexible cord.
Figure 2:
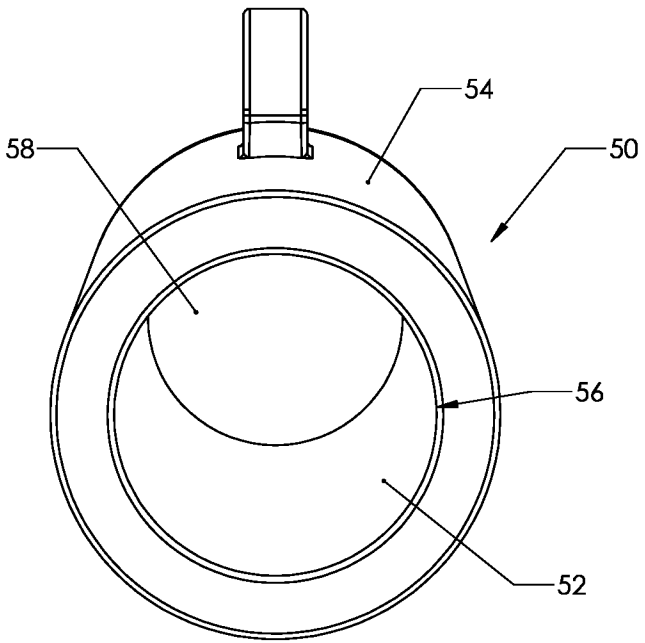
FIG. 2 is a top plan view of the interior of the cap portion of the present invention retractable cap of a caulking tube placed in a caulking gun.
Figure 3:
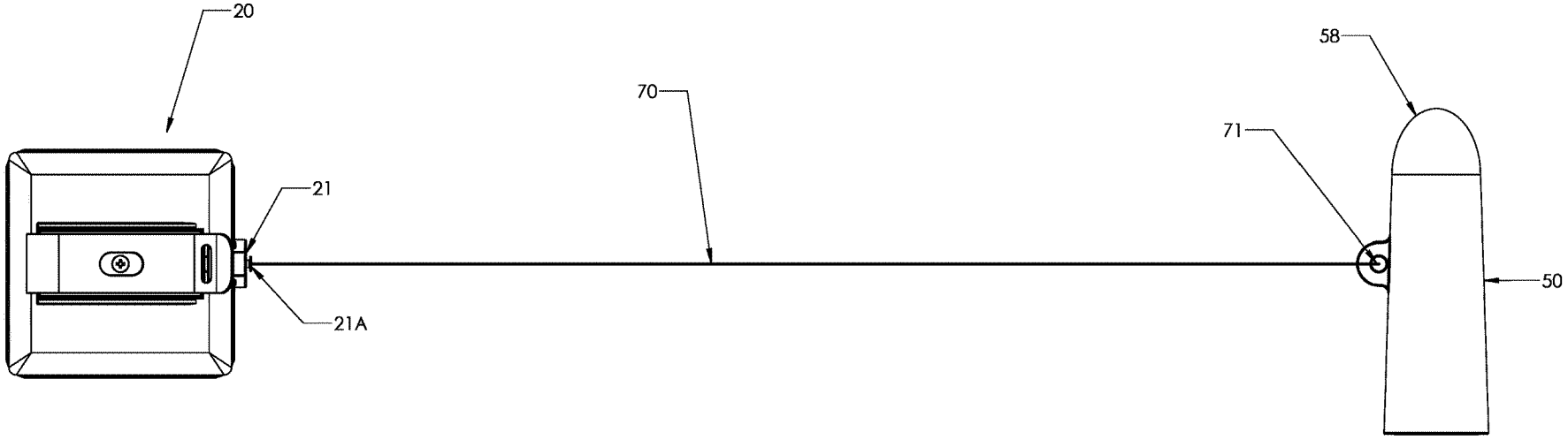
FIG. 3 is a side perspective view of the present invention caulking tube retractable cap in the extended position away from the housing which is removably affixed to a portion of a caulking gun adjacent the trigger.

Referring to FIGS. 1A, 1B, 1C, 2, and 3, caulking gun retractable cap 10 comprises a housing portion 20, a cap portion 50, and a flexible cord 70. As depicted in FIG. 1A and FIG. 1B, housing portion 20 has a housing front vertical wall 21 and a housing rear vertical wall 23. As shown by FIG. 1C, in the cross-sectional view of housing portion 20, the housing front vertical wall 21 has a front vertical wall opening 21A that leads into housing interior chamber 24, which contains a retraction member 75, such as a coiled spring 75, affixed to a proximal end 73 of the flexible cord 70. A distal end 71 of flexible cord 70 attaches to a closed end 58 of a cap 50 as depicted in FIG. 3.

As depicted in FIG. 2, cap 50 has an interior chamber 52 surrounded by a cylindrical vertical wall 54. Cap vertical wall 54 further contains a cap opening 56 at one end of cylindrical vertical wall 54, and further contains enclosed cap end 58 opposite to the cap opening 56 as also depicted in FIG. 3. Interior chamber 52 is sized to receive a tip of a nozzle 2010 of a caulking tube 2000 (illustrated in FIG. 4).

Referring back to FIG. 1A, housing portion 20 includes on exterior sidewall 28 a spring clip 26 for clipping the housing portion 20 to a caulking gun 1000. Although as depicted, a spring clip 26 is used, the spring clip 26 may be replaced by one or more strong magnets to attach housing portion 20 to caulking gun 1000. Other methods can be used to affix the housing portion 20 to caulking gun 1000, or the housing portion 20 may be integrated into the caulking gun 1000.

Figure 4:
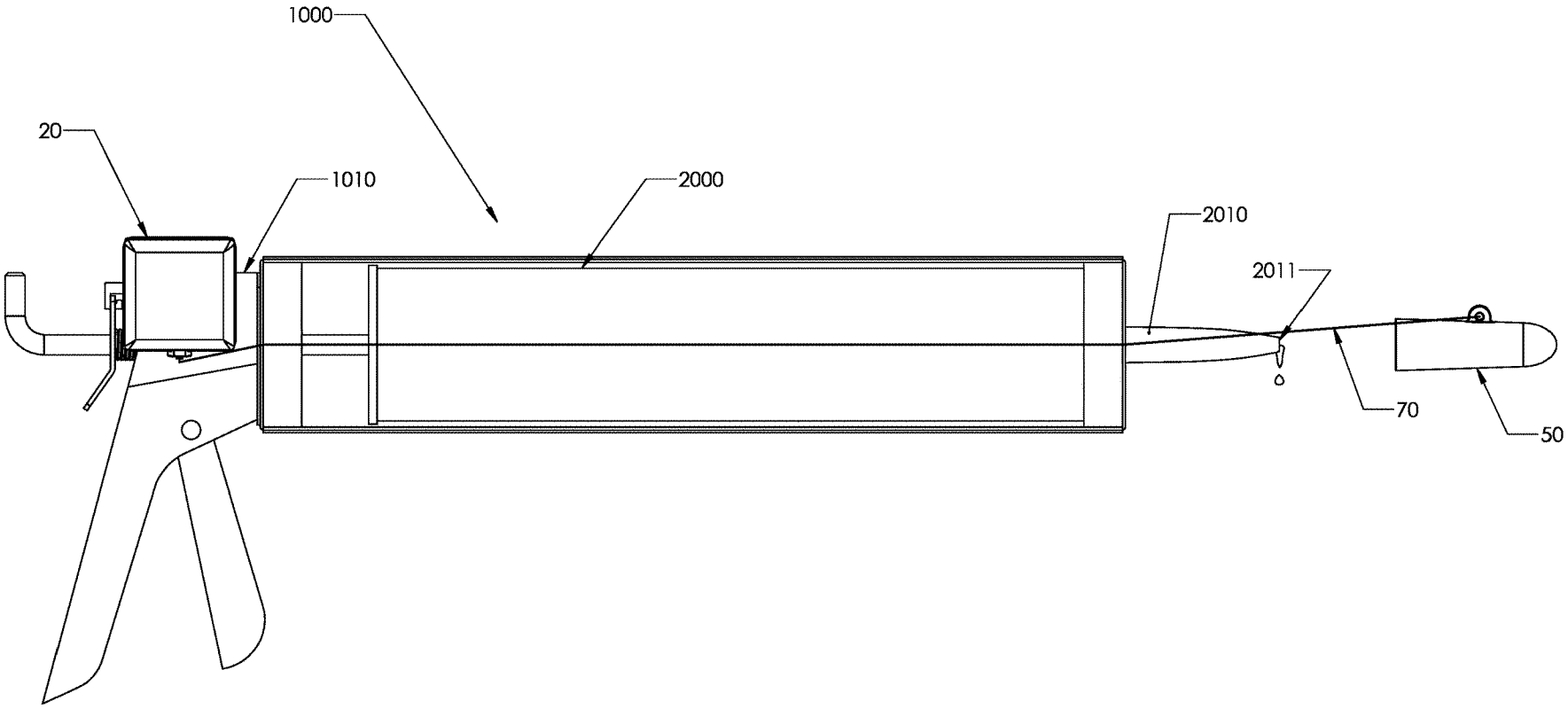
FIG. 4 is an exploded perspective view of the present invention caulking tube retractable cap separated from the caulking tube within a caulking gun with the clip portion of the present invention housing affixed to a rear sidewall of the caulking gun and the retractable cap extended beyond the location of the nozzle of a caulking tube retained in a caulking gun.

Referring to FIGS. 1B and 4, and more particularly to FIG. 1B, as depicted, housing portion 20 includes spring clip 26 affixed to at least one of the housing exterior sidewalls 28. Spring clip 26 has a first clip vertical wall 30 that is flush and parallel with at least one of the housing exterior sidewalls 28. First clip vertical wall 30 is retained within at least one housing exterior sidewall opening 28A. First clip vertical wall 30 extends towards housing rear vertical wall 23 and contains an approximate 180 degree curve 32 to form a second clip vertical wall 34 that extends at a downward angle towards at least one of the housing exterior sidewalls 28 until reaching a connection point 35 to contact either housing exterior sidewall 28 or first clip vertical wall 30 and then extend slightly upward for a distance 36. As noted earlier, spring clip 26 can be replaced by one or more strong magnets.

Referring again to FIGS. 1B and 4, in operation connection point 35 of spring clip 26 is extended outwardly to form a gap prior to placing housing portion 20 of the present invention caulking gun retractable cap 10 over a caulking tube nozzle 2010 (illustrated in FIG. 4). The spring clip 26 can be clipped onto the caulking gun 1000 proximate to a caulking tube retention 1010.

Referring again to FIGS. 1A, 1B, 1C, 2, and 3, and more particularly to FIG. 1C, as depicted, housing portion 20 includes housing interior chamber 24 containing coil spring 75 for retracting flexible cord 70. As depicted in FIG. 1C, coil spring 75 can be connected with proximal end 73 of the flexible cord 70 to wind and unwind around coil spring 75 as the flexible cord 70 is extended or retracted from housing interior chamber 24. As depicted in FIG. 3, when cap portion 50 is extended away from housing portion 20, coil spring 75 rotates to tighten and become loaded by forcing the coil springs 75 to wind together and create a retraction load or force onto flexible cord 70. As flexible cord 70 is pulled from housing portion 20, flexible cord unwinds from the interior chamber 24 and winds coil spring 75. The load created can cause cap portion 50 attached to distal end 71 of flexible cord 70 to retract toward housing portion 20 from an extended position when released if not prevented from retracting. Flexible cord 70 will be drawn into interior chamber 24 to wind around coil spring 75 by the load created by the wound coil spring 75, causing the closed end 58 of cap portion 50 to be retained against vertical wall opening 21A.

Figure 5:
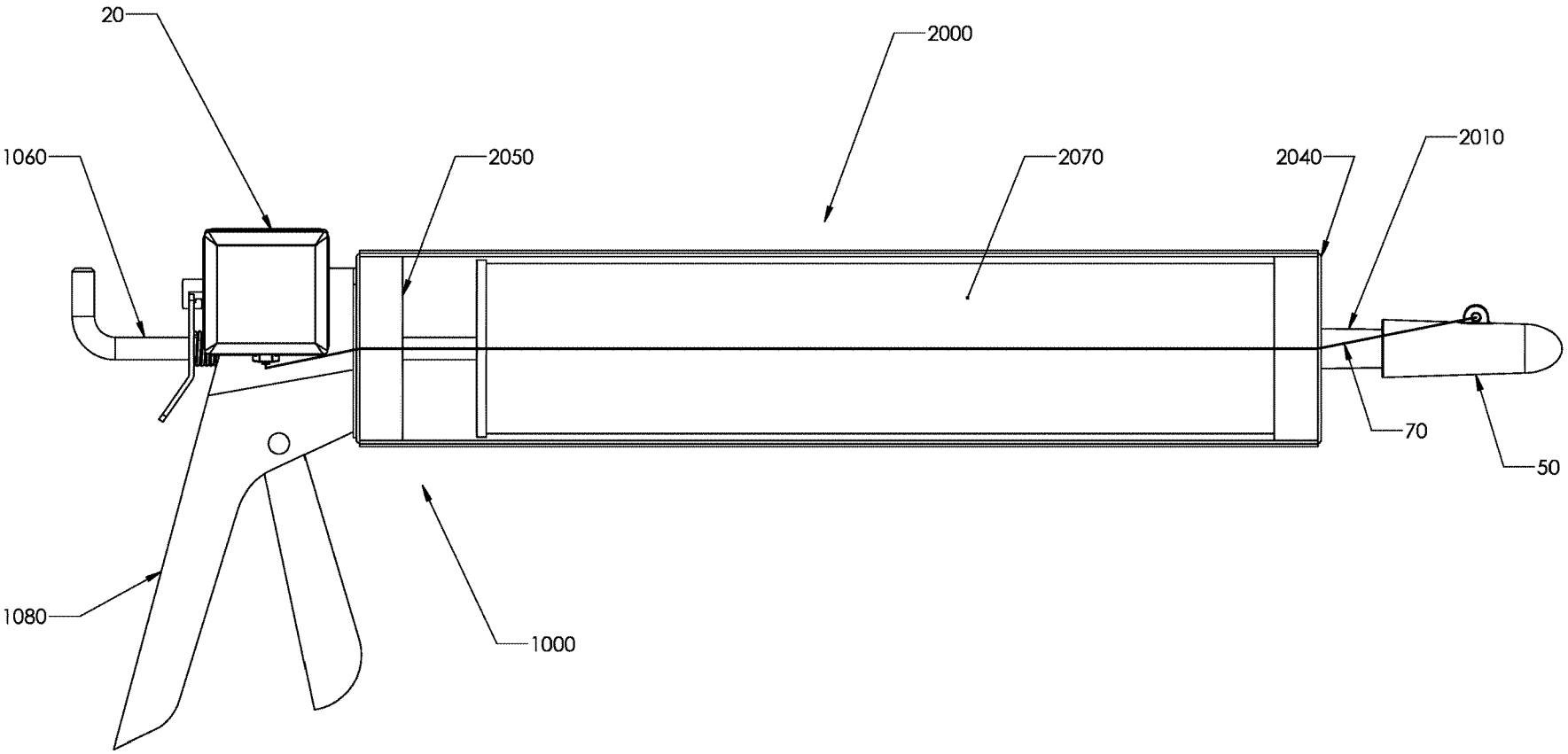
FIG. 5 is a perspective view of the present invention caulking gun retractable cap with the clip portion affixed to a rear sidewall of the caulking gun and the retractable cap extended and fitting on the nozzle of a caulking tube retained in the caulking gun.

Once the housing portion 20 is secured to caulking gun 1000 via spring clip 26, a user can extend cap portion 50 and flexible cord 70 to a desired distance as shown in FIG. 4, where cap portion 50 can be placed over the open tip 2011 of the nozzle 2010 as depicted in FIG. 5 to prevent leakage of silicone, latex or other caulking material 1000 during the non-use of the caulking gun. By extending flexible cord 70, a retraction load or force is created inside housing portion 20, which will act to retract flexible cord 70 into the housing interior chamber 24 if the cap portion 50 is removed from open tip 2011.

Further details of usage of the caulking tube retractable cap is provided in FIG. 5. As depicted in FIG. 5, caulking gun 1000 includes handle 1080 and ratchet 1060. Housing portion 20 is mounted so as to lie proximate to and between ratchet 1060 and rear end 2050 of caulking tube 2000. Caulking tube 2000 includes cylindrical body 2030 having a rear end 2050 and a front end 2040. Nozzle 2010 extends from front end 2040 and is capped by cap portion 50 to seal caulking material within caulking tube body 2030. Flexible cord 70 attaches to cap portion 50, so that when cap portion 50 is removed from nozzle 2010, flexible cord 70 under tension retracts into housing portion 20 and retain cap portion 50 next to and in contact housing portion 20.

It is within the spirit and scope of this invention for the housing portion 20 to be affixed to the caulking gun 1000 by other commonly known affixing mechanisms including, but not limited to, hook and loop fasteners (Velcro®), adhesive, rivets, buttons or snaps, and magnets. It is also within the sprit and scope of this invention for flexible cord 70 to be any retractable member commonly known including, but not limited to, a cord, a cable, a metal strip, or a strip of plastic. Further, it is within the spirit and scope of this invention for flexible cord 70 to be a stretchable member such as a piece of elastic or other stretchable member. In this alternative embodiment with the stretchable member, the retraction member or other spring would be unnecessary.

Insofar as the description above and the accompanying drawing disclose any additional subject matter that is not within the scope of the single claim below, the inventions are not dedicated to the public and the right to the one or more applications to claim such additional inventions is reserved.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The foregoing has described methods and systems for a retracting caulking tube nozzle cap that are given for illustration and not for limitation and uses. Thus the inventions are limited only by the appended claims. Although the inventions have been described in accordance with the embodiments shown, one of ordinary skill in the art will readily recognize that there could be variations to the embodiments and those variations would be within the spirit and scope of the present inventions. Accordingly, many modifications may be made by one of ordinary skill in the art without departing from the spirit and scope of the appended claims.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiment or form disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of the various references to provide yet further embodiments.

In light of the above "Detailed Description," the Inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed by the inventor. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described systems, articles of manufacture and methods. It is important to note that many implementations can be made without departing from the spirit and scope of the disclosure.

Modifications and Variations

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

Various materials may be used to construct the disclosed retracting caulking tube nozzle cap. For example, the housing may be constructed from hard plastic, metal, or a durable polymer or acrylic, and can constructed using pieces taken from mold.

Various methods can be used to affix the housing to the caulking gun as noted above. Further, the housing can be affixed to multiple locations on the caulking gun. For example, in an embodiment using a short flexible cord, the housing can be affixed proximate to front end 2040 of the caulking tube, and in some embodiments, can be attached to caulking tube 2030. In other embodiments, the housing can be integrated into the structure itself, such as by forging, casting, brazing, welding, or soldering. As used in the claims herein "affixed" includes the concept "integrated," such that an affixed housing portion may be structurally integrated into the caulking gun rather than requiring an "attached" structurally independent housing.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. An apparatus for capping a nozzle of a caulking tube retained in a caulking gun, the apparatus comprising:

a. a housing portion affixed to a caulking gun, a cap portion, and a flexible cord with said housing portion having a housing front vertical wall and a housing rear vertical wall;

b. said housing front vertical wall having a front vertical wall opening that leads into a housing interior chamber which contains a retraction mechanism that is affixed to a proximal end of said flexible cord;

c. a distal end of said flexible cord affixed to a closed end of said cap portion, said cap portion having an opening leading to an interior chamber that is surrounded by a circumferential vertical wall with said closed end opposite to the opening;

d. said interior chamber of said cap sized to receive a tip of said nozzle;

e. wherein, in operation, the cap is pulled away causing a pulling effect from the retraction mechanism and placed over the tip of the nozzle, the pulling effect causing the retraction mechanism to be forced into tension, and when the cap is removed from the tip of the nozzle, the retraction mechanism causes the flexible cord to be pulled back into the housing so that the cap retracts to adjacent to the exterior of the housing.

2. The apparatus for capping a nozzle of a caulking tube retained in a caulking gun of claim 1, the apparatus further comprising:

f. the housing portion comprising a spring clip affixed to at least one of exterior sidewalls of the housing portion with said spring clip having a first clip vertical wall that is flush and parallel with the at least one of the housing exterior sidewalls.

3. The apparatus for capping a nozzle of a caulking tube retained in a caulking gun of claim 2, the apparatus further comprising:

g. the first clip vertical wall is retained within at least one housing exterior sidewall opening and said first clip vertical wall extends towards said housing rear vertical wall and contains a 180 degree curve to form a second clip vertical wall that extends at a downward angle towards at least one of the housing exterior sidewalls until reaching a connection point and then extending upward for a distance.

4. The apparatus for capping a nozzle of a caulking tube retained in a caulking gun of claim 1, wherein the flexible cord comprises— a cord;
a cable;
a metal strip; or
a strip of plastic.

5. The apparatus for capping a nozzle of a caulking tube retained in a caulking gun of claim 1, wherein the housing portion attaches to the caulking gun using at least one of— hook and loop fastener;
adhesive;
rivets;
buttons or snaps; or
at least one magnet.

6. A retained caulking tube nozzle cap, the nozzle cap comprising:

a retention housing attached to a caulking gun having a caulking tube retained therein, the retention housing connected to a nozzle cap for capping a nozzle on the caulking tube;

a flexible cord housed within the retention housing, the flexible cord connecting the retention housing to the nozzle cap;

wherein the retention housing further comprises a retraction coil spring coupled to the flexible cord that winds up to create a retraction tension when the flexible cord extends to fit the nozzle cap onto the nozzle, and when said nozzle cap is removed from said nozzle, the retraction coil spring retracts the flexible cord into the retention housing to wind around the retraction coil spring and retain the nozzle cap adjacent to and in contact with said retention housing.

7. The retained caulking tube nozzle cap of claim 6, wherein the flexible cord comprises— cord;

a cable;

a metal strip; or a strip of plastic.

8. The retained caulking tube nozzle cap of claim 6, wherein the retention housing attaches to the caulking gun using a hook and loop fastener.

9. The retained caulking tube nozzle cap of claim 6, wherein the retention housing attaches to the caulking gun using an adhesive.

10. The retained caulking tube nozzle cap of claim 6, wherein the retention housing attaches to the caulking gun using rivets.

11. The retained caulking tube nozzle cap of claim 6, wherein the retention housing attaches to the caulking gun using buttons or snaps.

12. The retained caulking tube nozzle cap of claim 6, wherein the retention housing attaches to the caulking gun using at least one magnet.

13. The retained caulking tube nozzle cap of claim 6, wherein the retention housing attaches to the caulking gun using a spring clip.

14. The retained caulking tube nozzle cap of claim 6, wherein the retention housing is integrated into the caulking gun.

15. The retained caulking tube nozzle cap of claim 6, wherein the retention housing attaches to the caulking gun using rivets, buttons, or snaps.

16. A method of retaining a caulking tube nozzle cap on caulking gun, the method comprising:

attaching a retention housing to a caulking gun having a caulking tube retained therein, the retention housing connected to a nozzle cap for capping a nozzle on the caulking tube;

housing a flexible cord within the retention housing, the flexible cord connecting the retention housing to the nozzle cap;

winding a retraction coil spring within the retention housing by extending the nozzle cap to fit onto the nozzle to create a retraction force, the retraction coil spring coupled to the flexible cord; and removing said nozzle cap from said nozzle and allow the retraction force to retract the flexible cord into the retention housing to wind around the retraction coil spring and retain the nozzle cap adjacent to said retention housing.

17. The method of retaining the caulking tube nozzle cap of claim 16, wherein the flexible cord comprises— a cord;

a cable;

a metal strip; or a strip of plastic.

18. The method of retaining the caulking tube nozzle cap of claim 16, wherein the retention housing attaches to the caulking gun using a hook and loop fastener.

19. The method of retaining the caulking tube nozzle cap of claim 16, wherein the retention housing is affixed to the caulking gun using an adhesive, a magnet, or structural integration such as comprising welding or molding therewith.

20. The method of retaining the caulking tube nozzle cap of claim 16, wherein the retention housing attaches to the caulking gun using a spring clip.

* * * * *